US010427198B2

(12) United States Patent
Allevi et al.

(10) Patent No.: US 10,427,198 B2
(45) Date of Patent: Oct. 1, 2019

(54) DEVICE FOR BENDING A THREAD-LIKE MATERIAL

(71) Applicant: CRIPPA S.p.A., Arosio (CO) (IT)

(72) Inventors: Alessandro Allevi, Arosio (IT); Domenico Fulco, Arosio (IT)

(73) Assignee: CRIPPA S.p.A., Arosio (CO) (IT)

( * ) Notice: Subject to any disclaimer, the term of this patent is extended or adjusted under 35 U.S.C. 154(b) by 26 days.

(21) Appl. No.: 15/465,376

(22) Filed: Mar. 21, 2017

(65) Prior Publication Data

US 2017/0274436 A1 Sep. 28, 2017

(30) Foreign Application Priority Data

Mar. 23, 2016 (IT) ..... 102016000030413

(51) Int. Cl.

| | |
|---|---|
| ***B21D 7/00*** | (2006.01) |
| ***B21D 7/024*** | (2006.01) |
| ***B21D 7/16*** | (2006.01) |
| ***B21D 53/88*** | (2006.01) |

(52) U.S. Cl.

CPC ..... *B21D 7/024* (2013.01); *B21D 7/16* (2013.01); *B21D 53/88* (2013.01)

(58) Field of Classification Search

CPC ..... B21D 7/021; B21D 7/024; B21D 7/022

See application file for complete search history.

(56) References Cited

U.S. PATENT DOCUMENTS

| | | | | |
|---|---|---|---|---|
| 4,567,745 | A * | 2/1986 | Schwarze | B21D 7/02 72/157 |
| 4,888,971 | A * | 12/1989 | Schwarze | B21D 7/021 72/157 |
| 6,345,525 | B1 | 2/2002 | Bruyas et al. | |
| 2002/0104361 | A1 * | 8/2002 | Broggi | B21D 7/024 72/306 |
| 2005/0241356 | A1 * | 11/2005 | Yogo | B21D 7/024 72/149 |
| 2016/0023259 | A1 | 1/2016 | Jaubert et al. | |

* cited by examiner

*Primary Examiner* — Debra M Sullivan

(74) *Attorney, Agent, or Firm* — Greer Burns & Crain, Ltd.

(57) ABSTRACT

Device for bending a thread-like material, for instance a tube, with different angles and orientations, in particular for exhaust pipes and manifolds for cars, provided with at least two pairs of clamping jaws hooked to a rotary device.

5 Claims, 3 Drawing Sheets

DEVICE FOR BENDING A THREAD-LIKE MATERIAL

OBJECT OF THE INVENTION

The object of the present invention is a device for bending a thread-like material, for instance a tube, with different angles and orientations, in particular for exhaust pipes and manifolds for cars.

Present Status Of The Art

The bending machines used to bend a thread-like material with different angles and orientations shall be equipped with a plurality of pairs of clamping jaws. Such machines are used in a variety of industrial sectors. The sector in which said machines are mostly used is the manufacture of exhaust pipes and manifolds for cars.

At present, the bending machines known and used for this purpose basically comprise the features described in U.S. Pat. No. 6,345,525. Such machine comprises an elongated fixed frame secured to a bending head at one of its ends and to a bending arm pivoting about said bending head. It comprises a magazine device on the bending arm provided with a set of clamping jaws with different impressions. The magazine device rotates at the same time as said arm to shape the tube. The magazine device comprises means for being moved rotationally about its longitudinal axis and vertically about an axis perpendicular to the fixed structure. Said magazine device is provided with a holder of its own secured to the jaw support which slides along the bending arm. The mentioned vertical movement of the magazine device takes place along the mentioned support by means of a motor. Another motor makes it possible for the magazine device the mentioned rotation about its own longitudinal axis. The magazine is provided with at least two sets of clamping jaws positioned on its periphery and each portion thereof cooperates with the bending roller of the bending head and the jaw support of the bending arm respectively.

A drawback of said machine is in that it has machining times that are too long for the industries that use it, five movements being required for every bending of the tube.

For every machining, the magazine device shall rotate and vertically translate to position the appropriate clamping jaw around the tube to be bent, these being the first two movements. The bending made to bring a portion of the clamping jaw in the jaw support clamping position shall slide along the arm of the tube to be bent, third movement, bending of the tube, fourth movement, sliding of the jaw support in the reverse direction to free the bent tube, ready for the next operation, fifth movement. It also entails an excessive power consumption, in that it uses two motors to move the magazine device.

A more recent bending machine with the above mentioned purposes is described in patent application US 20160023259. This illustrates a device for bending profiled sections (T), for instance tubes, extending along a longitudinal axis (X). Said device comprises a combination of: at least one bend forming member oriented along a bending axis (Z) and orthogonal to the longitudinal axis (X), having a peripheral groove terminating at an indentation; at least two first clamping jaws stacked upon each other, each of which with a counter-clamping cavity for the profiled section (T) and a shape suitable for fitting into the indentation of the bend forming member; a vertical displacement means of the stack of the first clamping jaws suitable for moving the stack of first clamping jaws along an axis parallel to the bending axis (Z) to make it possible positioning of each first clamping jaw in the indentation of the bend forming member; at least two second clamping jaws stacked upon each other with cavities complementary to the cavities of the first clamping jaws.

As indicated above, the purpose of these machines is to bend a thread-like material with different angles and orientations. It is known that, for every bending angle or orientation of a thread-like material, for instance a tube, a specific pair of clamping jaws having an appropriate cavity is necessary. Should the bending angle or orientation of the thread-like material have to be modified, it is necessary to use different pairs of clamping jaws having different cavities. According to document US 20160023259 in order to modify the bending angle or orientation of a thread-like material, in order to replace the clamping jaws having a new cavity a displacement of the stack of the first clamping jaws is necessary along an axis parallel to the bending axis, so as to move the new clamping jaw of the stack of the first clamping jaws having an appropriate cavity into the indentation of the bend forming member and similarly to displace the stack of the second clamping jaws to produce an appropriate coupling between the new first clamping jaw and the complementary clamping jaw of the stack of the second clamping jaws. In practice, the time necessary to replace the cavity equals the time necessary to displace the stack of the first and second clamping jaws.

The device described in patent application US 20160023259 and the machine implemented according to said patent application have, amongst others, a drawback in that two stacks of clamping jaws have to be moved, which results in waste of energy and working times. Think to the case of a stack formed of three or four clamping jaws. Should the working cycle of the thread-like material comprise a first bending that uses clamping jaw 1 of both stacks, then clamping jaw 4 of both stacks and, as a last bending, clamping jaw 2 of both stacks. In order to perform the second bending, the stack of the first clamping jaws and that of the second clamping jaws shall be displaced all along its length and subsequently be moved again for almost all of its length in order to proceed to the third bending.

It immediately results from this short example that the working times and the energy consumed for such machining with the device described in document US 20160023259 is substantial.

DISCLOSURE OF THE INVENTION

The drawbacks of the known machines are solved by a device according to the present invention.

It is a device for bending a thread-like material, for instance a tube, along the longitudinal axis of said thread-like material.

The device comprises a bend forming member centered along the bending axis and perpendicular to the bending plane having a groove on its periphery terminating in an indentation cut in said bend forming member which comprises at least a first pair of clamping jaws and a second pair of clamping jaws. Said pairs of clamping jaws are hooked to a rotary device secured to the bending arm and having the axis of rotation parallel to the bending axis. The pairs of clamping jaws basically lay in a plane parallel to the bending plane and orthogonal to the bending axis.

The device according to the present invention comprises a relative displacement means for each pair of clamping jaws along an axis parallel to the bending axis to position each pair of clamping jaws on the bending plane to bend the thread-like material, for instance a tube. Each pair of clamping jaws operates with the positioning of one of the two portions that make-up the clamping jaw in the indentation of the bend forming member whereas the other portion of the clamping jaw clamps the thread-like material.

The configuration of the device according to the present invention makes it possible the use of a thread-like material cutting device positioned on the bending plane. Such positioning capability of the cutting device is very advantageous in that tube cutting can take place without being obliged to further move the clamping jaws, the latter being shaped in a way that is suitable both for bending the thread-like material and for clamping the bent thread-like material for its cutting by means of the mentioned cutting device.

DESCRIPTION OF THE FIGURES

FIG. 1 shows the bending device for a thread-like material (1), for instance a tube, along the longitudinal axis (X) of said thread-like material (1). The device comprises a bend forming member (2) centered along the bending axis (Z) and perpendicular to the bending plane (α), not graphically shown, having a groove (3) on its periphery terminating at an indentation (4) cut in said bend forming member (2).

FIG. 2 shows a first pair of clamping jaws ($\mathbf{5}^1$, $\mathbf{5}^2$) and a second pair of clamping jaws ($\mathbf{6}^1$, $\mathbf{6}^2$) hooked to a rotary device (7) having an axis of rotation parallel to the axis Z and secured to the bending arm (8). The first pair of clamping jaws ($\mathbf{5}^1$, $\mathbf{5}^2$) and the second pair of clamping jaws ($\mathbf{6}^1$, $\mathbf{6}^2$) basically lay in a plane parallel to the bending plane (α), not graphically shown, orthogonal to the bending axis (Z).

FIG. 3 shows the relative displacement means (9) of the first pair of clamping jaws ($\mathbf{5}^1$, $\mathbf{5}^2$) or of the second pair clamping jaws ($\mathbf{6}^1$, $\mathbf{6}^2$), not graphically shown, along an axis parallel to the bending axis (Z) to position the first pair of clamping jaws ($\mathbf{5}^1$, $\mathbf{5}^2$) or the second pair of clamping jaws ($\mathbf{6}^1$, $\mathbf{6}^2$) in the bending plane (α) for bending the thread-like material (1) or for cutting said thread-like material at the end of the working cycle by means of a cutting device (10), not graphically shown, positioned in the bending plane (α), not graphically shown. Said clamping jaws are shaped in a way suitable both for bending the thread-like material (1) and for clamping it after being bent for cutting.

Figure 1:
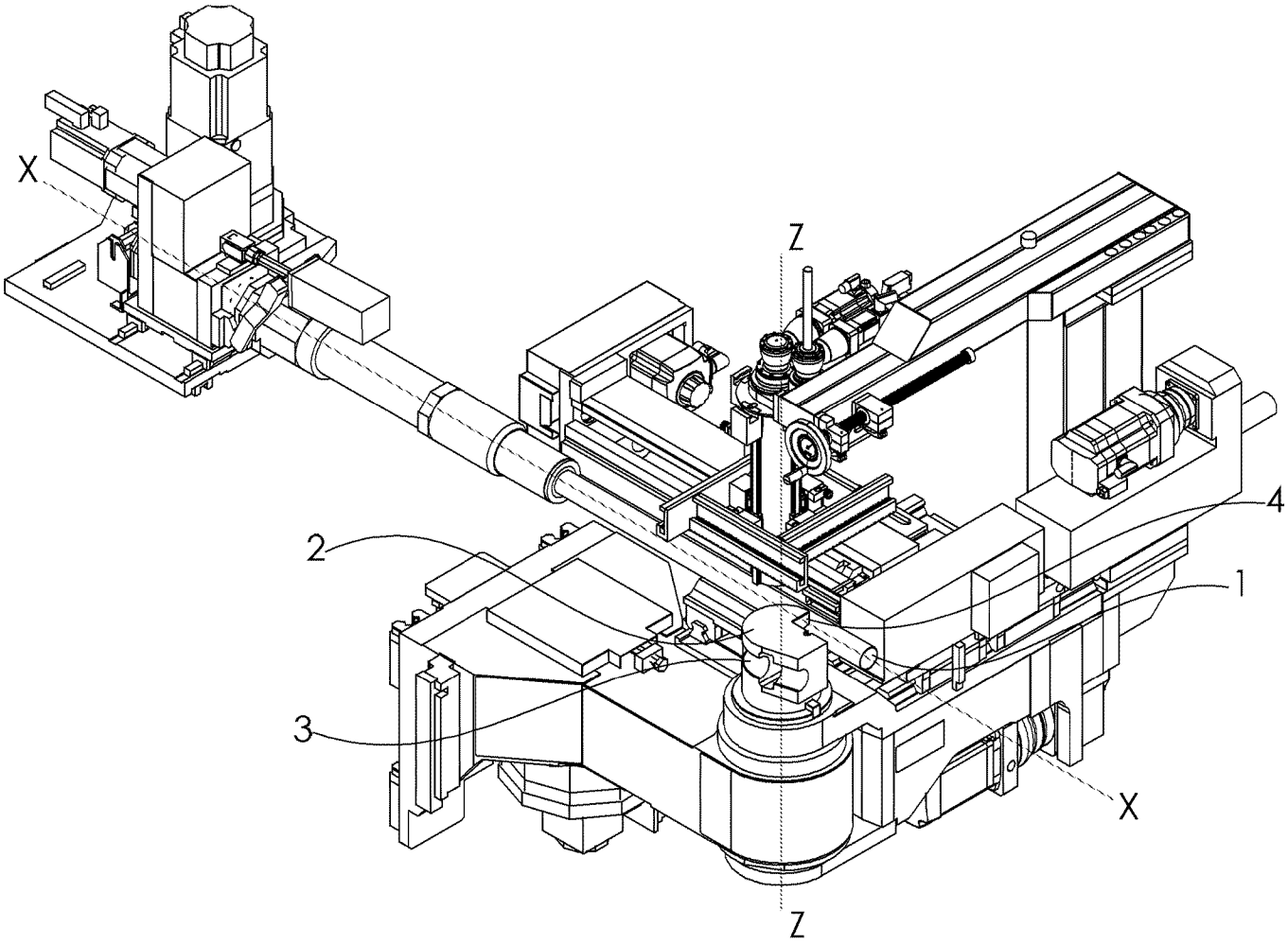
FIG. 1 shows a device according to the present invention in a tridimensional form.
Figure 2:
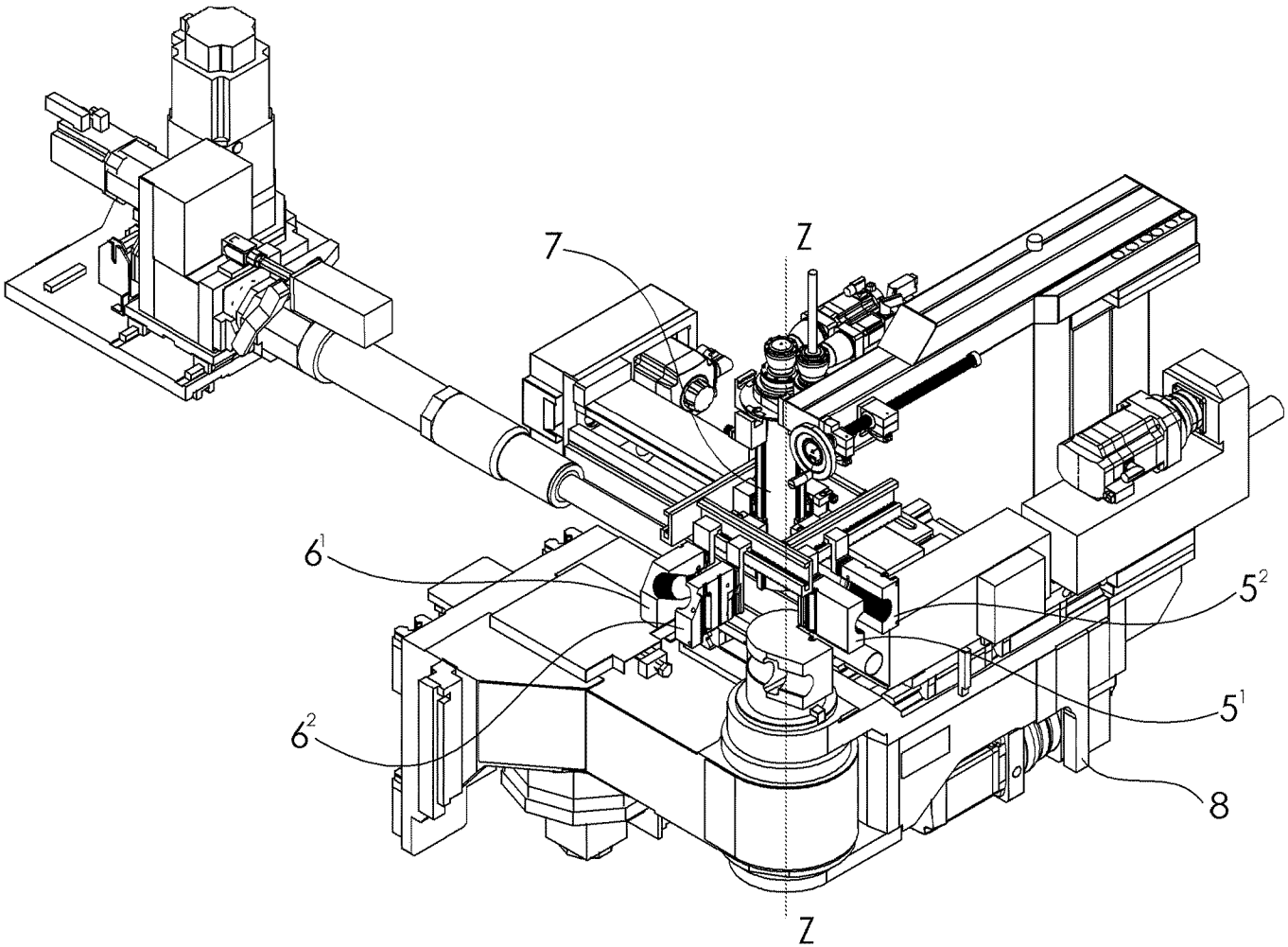
FIG. 2 shows a first pair of clamping jaws and a second pair of clamping jaws, hooked to a rotary device, in a tridimensional form.
Figure 3:
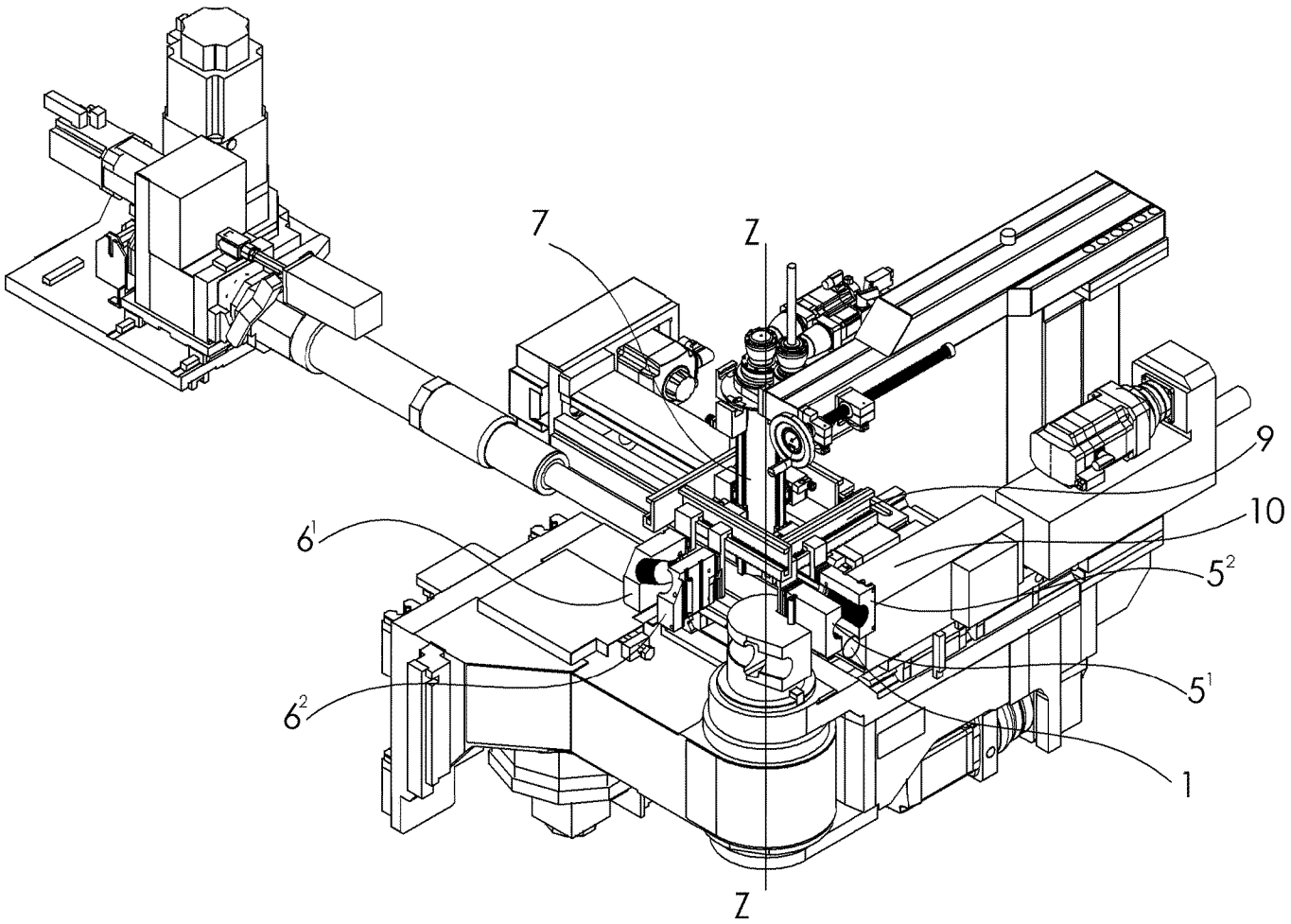
FIG. 3 shows the relative displacement means of the first pair of clamping jaws or of the second pair of clamping jaws and the cutting device in a tridimensional form.

The invention claimed is:

1. A device for bending a tube, along the longitudinal axis (X) of said tube, comprising:

a bend forming member centered for rotation about a bending axis (Z) and perpendicular to a bending plane, having a groove on its periphery terminating at an indentation cut in said bend forming member; and at least a first pair of clamping jaws and a second pair of clamping jaws hooked to a rotary device having an axis of rotation parallel to the bending axis (Z) and secured to a bending arm;

wherein the first pair of clamping jaws and the second pair of clamping jaws lay in a plane parallel to the bending plane and orthogonal to the bending axis (Z).

2. A device for bending a tube according to claim 1, further comprising relative displacement means of the first pair of clamping jaws or of the second pair of clamping jaws along an axis parallel to the bending axis (Z) for positioning the first pair of clamping jaws or the second pair of clamping jaws in the bending plane for bending a profiled section of the tube.

3. A device for bending a tube according to claim 1, further comprising:

relative displacement means of the first pair of clamping jaws or of the second pair of clamping jaws along an axis parallel to the bending axis (Z) for positioning the first pair of clamping jaws or the second pair of clamping jaws in the bending plane for bending a profiled section of the tube, wherein both the first pair of clamping jaws and the second pair of clamping jaws are suitable both for bending the profiled section and for clamping the bent profiled section for its cutting by means of a cutting device.

4. A device for bending a tube, along the longitudinal axis (X) of said tube, comprising:

a bend forming member centered for rotation about a bending axis (Z) and perpendicular to a bending plane, having a groove on its periphery terminating at an indentation cut in said bend forming member; and at least a first pair of clamping jaws and a second pair of clamping jaws hooked to a rotary device having an axis of rotation parallel to the bending axis (Z) and secured to a bending arm;

wherein the first pair of clamping jaws and the second pair of clamping jaws lay in a plane parallel to the bending plane and orthogonal to the bending axis (Z), and further comprising a cutting device for cutting the profiled section positioned in the bending plane.

5. A device for bending a tube according to claim 4, wherein both the first pair of clamping jaws and the second pair of clamping jaws are suitable both for bending the profiled section and for clamping the bent profiled section for its cutting by means of the cutting device.

* * * * *